United States Patent [19]

Hodges

[11] Patent Number: 4,475,688

[45] Date of Patent: Oct. 9, 1984

[54] ARTIFICIAL SNOW MAKING

[76] Inventor: James L. Hodges, 3 Hilltop Ave., Vernon, Conn. 06095

[21] Appl. No.: 423,674

[22] Filed: Sep. 27, 1982

[51] Int. Cl.[3] ..... F25C 3/04

[52] U.S. Cl. ..... 239/2 S

[58] Field of Search ..... 239/2 S, 14, 690

[56] References Cited

U.S. PATENT DOCUMENTS 2,695,002 11/1954 Miller ..... 239/690 X 3,703,991 11/1972 Eustis et al. ..... 239/2 S

*Primary Examiner*—Andres Kashnikow

[57] ABSTRACT

A method and apparatus for making artificial snow wherein a stream of compressed air and liquid water is expanded into a nucleating in which there is established an electrostatic field. By subjecting the expanding stream of compressd air and liquid water to the electrostatic field, the mean particle size of the ice nuclei formed in the nucleating zone is decreased and the number of ice nuclei particles produced for a given water flow is increased. Additionally, a stream of pressure water may be injected into the secondary air into which the ice nuclei pass in order to increase the humidity of the secondary air by atomizing the injected in a second electrostatic field.

8 Claims, 1 Drawing Figure

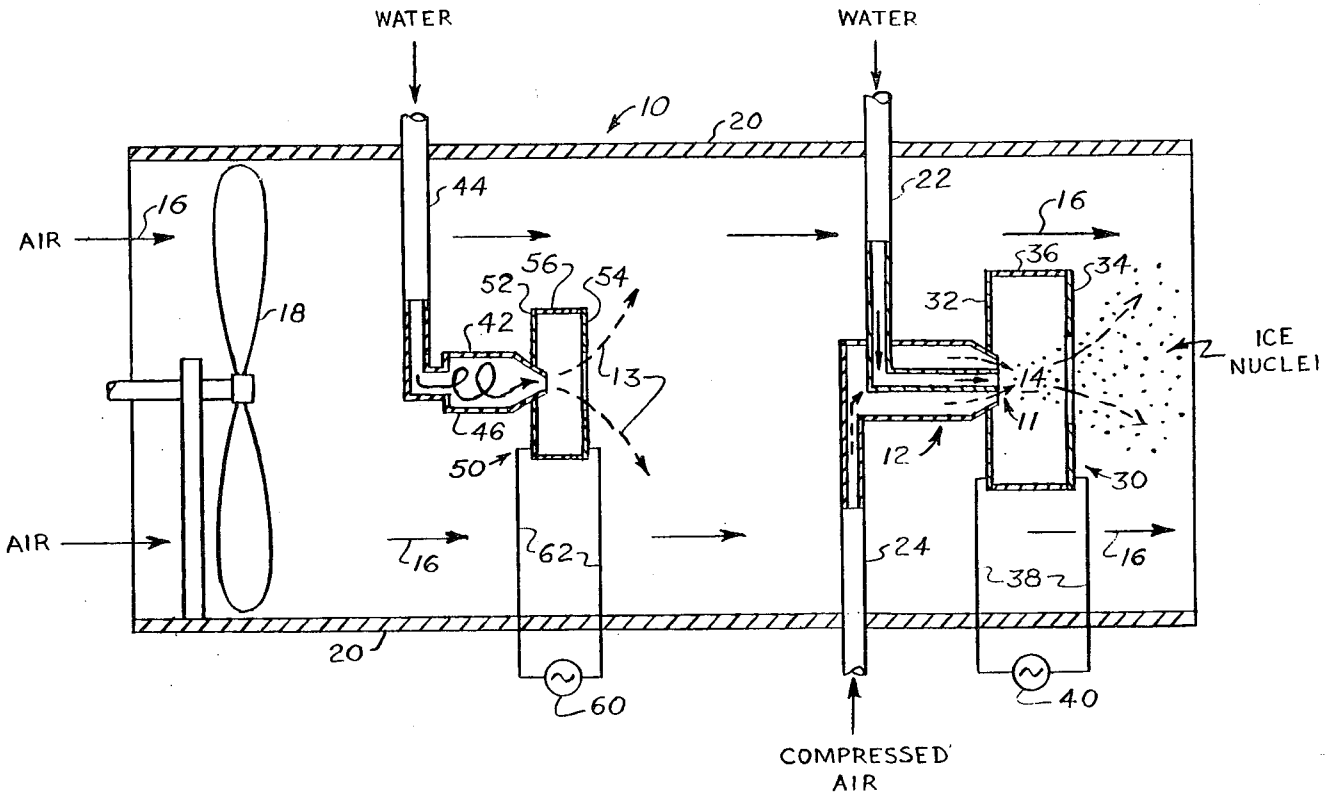
ICE NUCLEI
WATER
WATER
COMPRESSED AIR
AIR
AIR
10
11
12
13
14
16
18
20
22
24
30
32
34
36
38
40
42
44
46
50
52
54
56
60
62

ARTIFICIAL SNOW MAKING

BACKGROUND OF THE INVENTION

The present relates to the making of artificial snow and, more particularily, to a method for making artificial snow wherein the spray of water droplets from which the artificial snow is made is subject to an electrostatic field to improve the snow-making process.

Methods and apparati for making artificial snow are wellknown. Most snow-making techniques relay on the nucleation of at least a portion of a liquid water spray into ice nuclei about which additional water will crystalize upon introduction into sufficiently cold ambient air to form artificial snow-like crystals. Typically, the ambient air temperature should be no more than slightly above 0 C. and, preferrably, less than 0 C. for the efficient making of artificial snow.

Prior art snow making methods and apparati may generally be classified in two categories, which will for the sake of clarity be referred to herein as single air stream systems and dual air stream systems, respectively. In the typical single air stream system, a mixture of compressed air and liquid water is expanded through one or more atomizing nozzles to form one or more high velocity jets which are discharged directly into the atmosphere upon issuing from the nozzle.

In the typical dual air stream system, a secondary stream of high velocity air is established, typically by means of a large axial flow fan, into which the stream of compressed air and water, termed the primary air stream, issuing from the spray nozzle is injected. That is, in a secondary air system, the compressed air and liquid water of the primary stream is expanded into the secondary air stream rather than being expanded directly into the atmosphere. Typically, additional water is added to the secondary air stream to increase the humidity of the secondary air stream before the primary air stream with the ice nuclei contained therein is admixed therewith.

Examples of prior art snow making apparatus and methods which may be classified in either of the categories are disclosed in U.S. Pat. No. 2,968,164 (Hanson); U.S. Pat. No. 3,703,991 (Eustis et al.); U.S. Pat. No. 3,760,598 (Jakob et al.); U.S. Pat. No. 3,969,908 (Lawless et al.); U.S. Pat. No. 4,083,492 (Dewey); and U.S. Pat. No. 4,105,161 (Kircher et al.).

In the prior art snow making apparatus and methods of both the single air stream and also the dual air stream type, the nucleating process has not been fully appreciated and little effort has been expended in improving the nucleating process. Accordingly, compressed air requirements in present single air and dual air stream systems are unnecessarily and excessively large and add a needless expense to the snow-making operation due to the electrical energy which must be expended to operate compressors to provide the compressed air.

SUMMARY OF THE INVENTION

The general object of the present invention is to provide an improved method and apparatus for making artificial snow which avoids the use of excessive amounts of compressed air in forming ice nuclei crystals.

It is a further object of the present invention to improve the snow making process by reducing the mean particle size of the ice nuclei formed in the nucleating zone thereby decreasing the amount of compressed air required to form the ice nuclei.

In snow making systems of either the single air stream or the dual air system type, the principal function of the primary air stream is provide ice nuclei particles which will serve as sites for the crystal growth of snow upon subsequent exposure to water vapor in the atmosphere in a single air stream system or to water vapor in the secondary air stream in a dual air stream system. Through a thorough analysis of the snow-making process, the applicant has discovered that the mean particle size of the ice nuclei formed in the primary air stream has no influence on the rate of snow crystal growth or the ultimate size of the snow crystals subsequently grown on the ice nuclei. Rather, the snow-making capacity is a function of the number of ice nuclei present for snow crystals to grow upon.

In accordance with the present invention, the primary air stream of compressed air and liquid water is expanded into a nucleating zone in which there is established an electrostatic field. By subjecting the expanding stream of compressed air and liquid water to an electrostatic field, the mean particle size of the ice nuclei formed in the nucleating zone is decreased and the number of ice nuclei particles produced for a given water flow is increased. As the amount of compressed air required to convert a given water flow to ice nuclei is substantially linearly proportional to the amount of water to be converted, a higher ice nuclei formation can be maintained at a lower water flow, and therefore at a reduced compressed air requirement, than was possible in the prior art.

In a further aspect of applicant's invention, the liquid water being sprayed into the secondary air stream of a dual-air system to increase its humidity is subjected to an electrostatic field simultaneously with spraying liquid water into the secondary air stream thereby causing a reduction in the mean particle size of the water vapor particles forming therein and also resulting in a reduction in the time required to vaporize the liquid water sprayed in the secondary air stream. As a consequence, the absolute humidity of the secondary air stream is increased at the point of injection of the ice nuclei from the primary stream into the secondary air stream thereby improving snow-making capacity.

BRIEF DESCRIPTION OF THE DRAWING

Additional objects as well as the advantages and features of the present invention will be best understood from the following description with reference to the accompanying drawing wherein there is depicted a side elevational view, partly in section, of a snow-making apparatus incorporating the present invention.

DESCRIPTION OF THE PREFERRED EMBODIMENT

Referring now to the drawing, there is depicted therein an apparatus 10 for carrying out the artificial snow-making method of the present invention. As in the typical prior art snow-making method to which the present invention is directed, a stream 11 of liquid water and compressed air is expanded through an atomizing means 12 into a nucleating zone 14 wherein the atomized water droplets are cooled by heat given off as the compressed air expands and solidified to form ice nuclei. The ice nuclei formed in the nucleating zone 14 then pass either directly into the atmosphere if a single air system is used or, if as shown in the drawing a dual air system is used, the ice nuclei pass into a secondary air stream 16 which assists in dispersing the ice nuclei into the atmosphere.

The ice nucleir serve as crystallization sites for the subsequent growth of snowflakes upon interduction of the ice nuclei into either the atmosphere or the secondary air stream. Water vapor present in the atmosphere or in the secondary air stream crystallize on the ice nuclei to form the snowflakes which subsequently fall to the ground. The growth of the snowflakes can be accelerated by increasing the absolute humidity of the air into which the ice nuclei formed in the nucleating zone are interspersed. One method of increasing the absolute humudity is by injecting a stream 13 of liquid water into the secondary air stream 16 as shown in the drawing.

In accordance with applicant's invention, an electrostatic field is established about the nucleating zone 14. The atomization of the liquid water issuing from atomizing means 12 occurs within the nucleating zone 14 under the influence of the electrostatic field which agitates the water droplets and reduces the surface tension of the droplets thereby enhancing the atomization process and resulting in a reduction in the mean particle size of the atomized water droplets and, therefore, a reduction in the mean particle size of the subsequently formed ice nuclei.

On a further aspect of the present invention, an electrostatic field is also established about the liquid water stream 13 being sprayed into the secondary air stream 16 thereby subjecting the liquid water droplets in stream 13 to an electrostatic field during the atomization process. As in the case of the primary air water droplets, the influence of the electrostatic field agitates the water droplets and reduces the surface tension of the droplets thereby enhancing the atomization process and causing a reduction in the mean particle size of the atomized water droplets. As a consequence, the absolute humidity of the secondary air stream 16 is increased rapidly.

A more thorough understanding of the present invention may be attained through a brief discussion of the operation of the snow-making apparatus 10 which incorporates the present invention. It should be understood that the snow-making apparatus 10 is shown in the drawing as an apparatus of the dual-air system type merely for purposes of illustration and not limitation. The present invention also has direct application to snow-making apparatus of the single air system type.

In the operation of the snow-making apparatus 10, a fan 18 disposed at the inlet of a tubular tunnel-like housing 20 is actuated by means of a motor (not shown) to move a volume of ambient air 16, termed secondary air, through the housing. Disposed in housing 20 downstream of the fan 18 is a first atomizing nozzle 12 through which a stream 11 of liquid water and compressed air is sprayed into the secondary air stream 16. The nozzle 12 is connected to a water supply by means water supply conduit 22 which passes through the housing 20. Additionally, the nozzle 12 is connected to a supply of compressed air or a compressor (not shown) by means of compressed air supply conduit 24.

The atomizing nozzle 12 is shown in the drawing to be a conventional atomizer of the air blast type, although any of a number of well-known atomizers such as, but not limited to, other conventional aerodynamic, mechanical and ultrasonic atomizers, may be employed. In the air blast atomizing nozzle 12, the relatively high velocity compressed air from conduit 24 is accelerated through the annular opening of the convergent tip of the nozzle 12 to physically impinge upon the relatively low velocity stream of liquid water which is sprayed conically outward through a spray head mounted on the end of the supply conduit 22. The high velocity compressed air induces atomization of the liquid water to form the stream 11 of compressed air and liquid water droplets which is expanded in the nucleating zone 14.

An electrostatic field is established in the nucleating zone 14 by electric field generator 30. The electric field generator 30 is comprised of a first electrode plate 32, termed a nozzle plate, mounted to the nozzle 12, a second electrode plate 34, termed a field plate, and an electrically non-conductive insulator support housing 36 interconnecting the field plate to the nozzle plate for support. The atomized water droplets and the expanding compressed air stream 11 passes through a central opening in the field plate to enter the secondary air stream 16 passing through the housing 20.

To establish an electrostatic field in the nucleating zone 14, a voltage is applied by voltage generator 40 preferably disposed outside of the housing 20 and electrically connected to generator 30 by leads 38, to nozzle plate 32, and the nozzle 12 connected thereto, with respect to the field plate 34. The voltage applied may be either alternating or direct current, and, if desired, may be varied periodically in strength and frequency to enhance atomization. Further, the nozzle plate 32 and field plate 34 may be curved in order to shape the electric field in the region of the nucleating zone 14 in the vicinity of the outlet of the nozzle 12. By adjusting the stength and frequency of the electrostatic field, the distance between the electrode plates, the shape of the electrode plates, and the extension of the tip of the nozzle 12 beyond the nozzle plate 32, the influence of the electrostatic field upon the water droplets can be optimized.

While the momentum of the high velocity expanding compressed air leaving the nozzle 12 breaks up the liquid water in the presence of the electrostatic field to water droplets of a reduced particle size, the expansion of the compressed air in the nucleating zone 14 causes the water droplets to freeze and form ice nuclei. The change in phase of the water droplets in the nucleating zone is an exothermic process. The expansion of the compressed air in the nucleating zone is however an endothermic process resulting in a reduction inhe air temperature in the nucleating zone 14. The cool expanded air therefor acts as a heat reservior accepting the heat which must be removed from the liquid water droplets in order to effect the change of the droplets into the ice nuclei which subsequently serve as crystallization sites for the formation of snow crystals.

In order to further enhance the snow-making process, it is preferrable to increase the absolute humidity of the secondary air steam 16. Additional water is injected into the secondary air stream 16 through a second atomizer 42 which is shown as a pressure jet atomizer, although any of a number of well-known conventional atomizers may be used. The second atomizer 42 may be disposed downstream of the ice nuclei nucleating zone 14 or upstream of the ice nuclei nucleating zone as shown in the drawing.

The second atomizer 42 is connected to a supply of pressurized water by means of water supply conduit 44 which passes through the housing 20. The pressurized water passes from the supply conduit 44 into the swirl chamber 46 of the atomizer 42 wherein angular rotation is applied to water to cause the liquid water stream 13 to fan out upon accelerating thru the convergent tip of the atomizer 42 and disperse into the secondary air stream 16.

In accordance with the invention, an electrostatic field is established about the liquid water stream 13 as it discharges from the pressurize jet atomizer 42 by an electric field generator 50. The electric field generator 50 is similar to the previously described electric field generator 30 and is comprised of a first electrode plate 52, termed a nozzle plate, mounted to the atomizer 42, a second electrode plate 54, termed a field plate, and an electrically non-conductive insulator support housing 56 interconnecting the field plate to the nozzle plate for support. The pressurized water jet 13 discharging from the atomizer 42 passes through the electrostatic field established by the generator 50 and thence passes thru a central opening in the field plate 54 to disperse into the secondary air stream 16 passing through the housing 20.

To establish the electrostatic field about the pressure jet 13, a voltage is applied to the nozzle plate 52, and the atomizer 42 connected thereto, with respect to the field plate 54 by means of a voltage generator 60 which is preferrably disposed outside of the housing 20 and electrically connected to the generator 50 via leads 62. As discussed with respect to the electrostatic field generator 30, the influence of the electrostatic field upon atomizing process may be optimized by adjusting the strength and frequency of the electrostatic field, the distance between the electrode plates, the shape of the electrode plates, and the extension of the tip of the atomizer 42 into the electrostatic field.

The finely atomized water droplets passing from the electrostatic field generator 50 associated with the atomizer 42 evaporate to form water vapor thereby increasing the absolute humidity of the secondary air stream 16 substantially above the ambient air humidity, and also causing a reduction in the temperature of the secondary air stream 16. As the evaporation process is an endothermic process, heat is absorbed from the secondary air stream 16 resulting in the secondary air stream 16 being cooled. Therefore, the secondary air stream 16 will be lower in temperature than the ambient air around the housing 20. Therefore, snow flakes will form on the ice nuclei injected into the secondary air stream 16 even when the local ambient air temperature is slightly above 0 C. provided sufficient water is evaporated into the secondary air stream.

By applying an electrostatic field to the pressure water jet 13 as it leaves the atomizer 42, the atomization process is enhanced and the mean particle size of the resultant atomized water droplets reduced. Because of the reduced mean particle size of the atomized water droplets, a greater number of the water droplets will evaporate in the secondary air stream 16 in a shorter period of time. Therefore, the humidity of the secondary air stream will rise faster and the temperature of the secondary air stream decrease faster than would occur without the enhancement of the atomization process by the application of the electrostatic field.

Through the application of the present invention, therefore, the snow-making process can be made more efficient and more economical. By applying an electrostatic field to the water injected into the primary air stream of expanding compressed air, the mean particle size of the resultant ice nuclei is reduced. Accordingly, the number of ice nuclei produced for a given water flow increases. As snow-making capacity is a function of the number of ice nuclei available for snow crystallization, the efficiency of the snow-making process can be maintained at a reduced water flow rate and, therefore, reduced compressed air requirements thereby resulting in a more economical snow-making process.

Further, by applying an electrostatic field to the water injected into the secondary air stream, the mean particle size of the atomized water droplets is reduced thereby leading to improved and quicker evaporization of the water droplets in the secondary air stream. The resultant increase in humidity and drop in temperature of the secondary air stream serves to hasten and improve the crystallization of the snow-flakes upon the ice nuclei injected into the secondary air stream. Therefore, a more efficient snow-making process results.

With reference to the present invention, it is to be understood that the term liquid water, as used herein with reference to stream 11 and stream 13, is not limited to distilled water, but rather is to be read to include liquid water mixed with a refrigerant, a surfactant, or a seed crystal particle. A refrigerant would when expanded in stream 11 change phase absorbing heat from the primary air thereby further reducing the temperature of the primary air and enhancing ice nuclei formation. A surfactant is a surface-active agent which would reduce the surface tension of the atomized water droplets thereby aiding in the reduction of mean particle size of the ice nuclei and of the water droplets injected into the secondary air stream. A seed crystal particle is a fine particle of a foreign crystalline substance which serves as site for ice nuclei formation in the primary air stream and also snow-crystallization in the secondary air stream.

Refrigerants, for example, which may be used include, but are not limited to, alcohols, alkanes, and various liquified gases. Surfactants which may be used include methyl alcohol, ethyl alcohol, acetic acid, acetone and various well known water-soluble detergents and wetting agents. Seed crystals which may be used include, for example, silver iodide and lead iodide. Furthermore, the mineral particles found in pond water can serve as seed crystals.

Although the present invention has been described herein with reference to the particular dual air stream snow-making apparatus shown in the drawing, it is to be understood that the present invention may be employed on any snow-making system wherein water is atomized into an air stream or the atmosphere to produce the snow. Although the particular embodiment shown in the drawing employs a single atomizer for injecting water into the primary air stream and also a single atomizer for injecting water into the secondary air stream, it is also be understood that a plurality of either or both of the atomizers may be used and that any of a number of conventional types of atomizers may be employed.

I claim:

1. A method for making snow comprising:

a. expanding a stream of compressed air and liquid water in a nucleating zone to form water droplets which upon cooling during the expandion step form ice nuclei particles therein;

b. establishing an electrostatic field about said nucleating zone and subjecting the air and water stream expanding in said nucleating zone to said electrostatic field during the expansion step thereby increasing the number of ice nuclei formed; and c. subsequent to the expansion step, discharging the ice nuclei particle containing stream into the atmosphere.

2. A method a recited in claim 1 further comprising:

a. establishing a secondary stream of relatively high velocity air;

b. spraying liquid water into said secondary air stream; to form water droplets thereby humidifying said secondary air stream;

c. establishing a second electrostatic field about the liquid water bein sprayed into said secondary air stream so as to subject the liquid water being sprayed into the secondary air stream to said second electrostatic field thereby causing smaller water droplets to form whereby the process of humidifying said secondary air steam is enhanced; and d. prior to discharging the ice nuclei particle containing stream into the atmosphere along with said secondary air stream as a dispersant therefor, injecting said ice nuclei particle containing stream into said humified secondary air stream.

3. A method as recited in claim 2 wherein the step of spraying liquid water into said secondary air stream comprises:

a. establishing a second electrostatic field; and b. spraying liquid water through said electrostatic and thence into said scondary air stream so as to atomize the liquid water in the presence of said electrostatic field.

4. A method as recited in claim 1 wherein the liquid water in the stream of compressed air and liquid water comprises liquid water and a refrigerant.

5. A method as recited in claim 3 wherein the liquid water of at least one of the liquid water streams comprises liquid water and a surfactant.

6. A method as recited in claim 3 wherein the liquid water of at least one of the liquid water streams comprises liquid water and seed crystals of a foreign crystalline substance.

7. A method as recited in claim 1 wherein the liquid water in the stream of compressed air and liquid water comprises liquid water and a surfactant.

8. A method as recited in claim 1 wherein the liquid water in the stream of compressed air and liquid water comprises liquid water and seed crystals of a foreign crystalline substance.

* * * * *